United States Patent [19]

Meffert et al.

[11] 4,429,294

[45] Jan. 31, 1984

[54] COIL FORM FOR ELECTRIC WINDINGS

[75] Inventors: Harald Meffert, Dusseldorf; Rolf Pieper, Wuppertal-Ronsdorf, both of Fed. Rep. of Germany

[73] Assignee: Firma W. Meffert KG., Erkrath-Unterfeldhaus, Fed. Rep. of Germany

[21] Appl. No.: 246,195

[22] Filed: Mar. 23, 1981

[30] Foreign Application Priority Data

Mar. 21, 1980 [DE] Fed. Rep. of Germany ..... 3010823
Mar. 19, 1981 [DE] Fed. Rep. of Germany ... 8108092[U]

[51] Int. Cl.[3] ..... H01H 85/02

[52] U.S. Cl. ..... 336/198; 336/60; 336/207; 336/208

[58] Field of Search ..... 336/60, 198, 207, 208

[56] References Cited

U.S. PATENT DOCUMENTS

| | | | |
|---|---|---|---|
| 1,473,862 | 6/1918 | Nyman | 307/13 |
| 1,629,148 | 6/1927 | Chauncey | 336/208 |
| 1,888,541 | 11/1932 | Rigante | 336/208 |
| 3,108,763 | 10/1963 | Ahlene | 336/208 |
| 3,329,374 | 7/1967 | Stanton, Jr. | 242/118.4 |
| 3,352,509 | 12/1965 | Kort | 242/118.4 |

FOREIGN PATENT DOCUMENTS

| | | |
|---|---|---|
| 1294541 | 5/1963 | Fed. Rep. of Germany . |
| 1514555 | 3/1971 | Fed. Rep. of Germany . |
| 1774149 | of 0000 | Fed. Rep. of Germany . |
| 1574441 | 12/1971 | Fed. Rep. of Germany . |
| 2162104 | 6/1974 | Fed. Rep. of Germany . |
| 2401237 | 3/1975 | Fed. Rep. of Germany . |
| 6606938 | of 0000 | Fed. Rep. of Germany . |
| 7529479 | 9/1975 | Fed. Rep. of Germany . |
| 2432919 | 12/1976 | Fed. Rep. of Germany . |
| 2425899 | 7/1978 | Fed. Rep. of Germany . |
| 1173989 | of 0000 | France . |
| 1592347 | 5/1970 | France . |
| 2089249 | of 0000 | France . |
| 2255687 | of 0000 | France . |
| 2332601 | of 0000 | France . |
| 231590 | of 0000 | Switzerland . |
| 1503318 | of 0000 | United Kingdom . |

*Primary Examiner*—A. T. Grimley
*Assistant Examiner*—S. A. Steward
*Attorney, Agent, or Firm*—Schwartz, Jeffery, Schwaab, Mack, Blumenthal & Koch

[57] ABSTRACT

A coil form for a transformer having air-cooled electric windings. Plug-in frames which can be adjusted in width and/or height are provided at the ends of the device. Profiled bars and additional supporting members, both of which can be of any desired length, are mounted between the frames at each corner thereof and are laterally spaced so as to space the coil windings wrapped therearound.

13 Claims, 8 Drawing Figures

Fig. 1
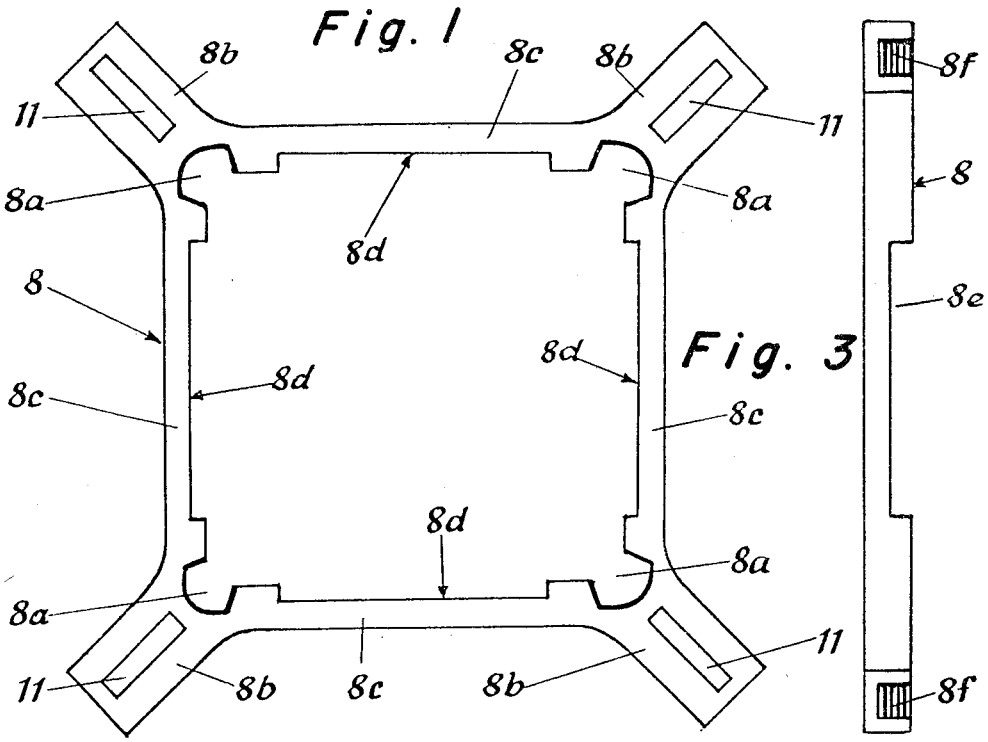
Fig. 3
Fig. 2
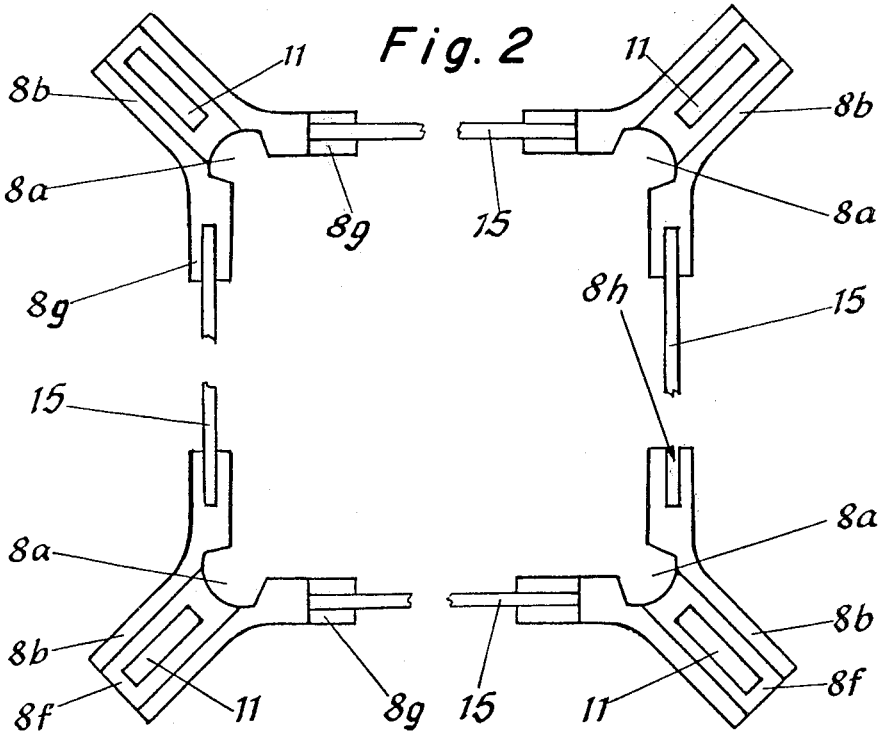

COIL FORM FOR ELECTRIC WINDINGS

BACKGROUND OF THE INVENTION

This invention generally concerns a coil form for air-cooled electric windings of a transformer and more particularly to a coil form with carrying means, disposed parallel to the longitudinal axis of the form, serving on one hand as a holder for an iron core and on the other hand as a carrier for at least one inner and one outer winding, with supporter means delimiting the carrying means at their faces.

One of the most current coil forms of the type concerned here consists of a square cylinder, which, at each of its faces, passes over into a collar-like flange, which, in respect to the compact shell, is perpendicularly directed to the outside. The cylinder covers the iron core, serving at the same time as a carrier for the inner winding. The outer winding is placed on bars, which are disposed between the flanges parallel to the longitudinal axis of the form, the ends of the bars fitting into radial rim slots at the corners of the flanges.

This known coil form has the considerable disadvantage that for coils of different size, production of coil forms of different size is necessary according to the requirements concerning the power and other electromagnetic properties. Even if the coils within a certain range of dimensions differ from each other only in one dimension, and thus in their length, width or height only, each of these coils requires a special coil form. These coil forms can only be produced by a pressing or die-casting process, so that for each size of coil form a special mold must be produced, and this requires a considerable expenditure. With regard to the need for the availability of all deliverable coil sizes within a certain period, independently of the real consumption of the different sizes, it is therefore necessary for the producers as well as for the consumers to keep in stock the complete large collection of coil forms. Such an extensive stock-keeping causes high costs and is, especially in small enterprises, often not realizable in the required volume because of lack of the necessary store-room.

It is a further disadvantage that the cylinder carrying the inner winding has a compact shell, because this prevents a sufficient air-circulation, which is indispensible for carrying off the heat produced during operation of the coil. In order to avoid this disadvantage the iron cores are made from a material of better quality, but this entails a considerable rise of production costs, especially in the case of transformers with large dimensions. Besides that, large quantities of material are required for the construction of these coil forms with compact shells, and costs will be increased if high quality and expensive material, as for instance glass fiber reinforced plastics, must be used because of the high temperature stability required.

It is the object of the present invention to create a coil form, which is adaptable to different sizes, permits a convenient air circulation between the windings, and the production of which is simple and requires small quantities of material.

According to the present invention this object is achieved by creating a coil form consisting as to all directions of plug elements, which are engageable with each other in a detachable way. A preferred model of this coil form has holders at its faces, which are designed as plug-in frames, in the clearances of which there can be inserted sets of carrying elements with variable length but with equal length within a set. The carrying elements take the form of profiled bars or distance pieces, and each plug-in frame is provided with at least three, by preference four, sides, each with a variable length. The ends of two adjacent sides pass respectively over into a flange directed to the outside, these figures being provided with a U-shaped channel for receiving the distance pieces at the sides of the plug-in frame pairs, which face each other.

The coil form, according to this invention, is superior to the conventional coil forms of this type by being designed on the basis of the mechanical assembly technique, thus permitting assembly by the simple fitting together of individual elements. It is possible to produce a large number of coil forms of different sizes by combining the framework-parts, which are necessary for obtaining two plug-in frames, and which have one and the same size, with sets of different length of side connection pieces and carrying elements.

A further advantage of the invented coil form is that its component parts can be produced in a simple and relatively cheap way by extrusion, stamping or pressing. Expensive production of molds is not necessary.

Additionally, the space saving storage and package of the component parts of the coil form represents another advantage for their stock-keeping and forwarding.

BRIEF DESCRIPTION OF THE DRAWINGS

Preferred embodiments of the invented coil form are shown in the drawing and will be described in detail hereinafter. In the drawings:

FIG. 1 is a front elevational view of a rectangular plug-in frame with unvariable side length;

FIG. 2 is a side elevational view of a rectangular plug-in frame with variable side length;

FIG. 3 is a side view of the plug-in frame shown in FIG. 1;

DETAILED DESCRIPTION OF THE PREFERRED EMBODIMENTS

Figure 6:
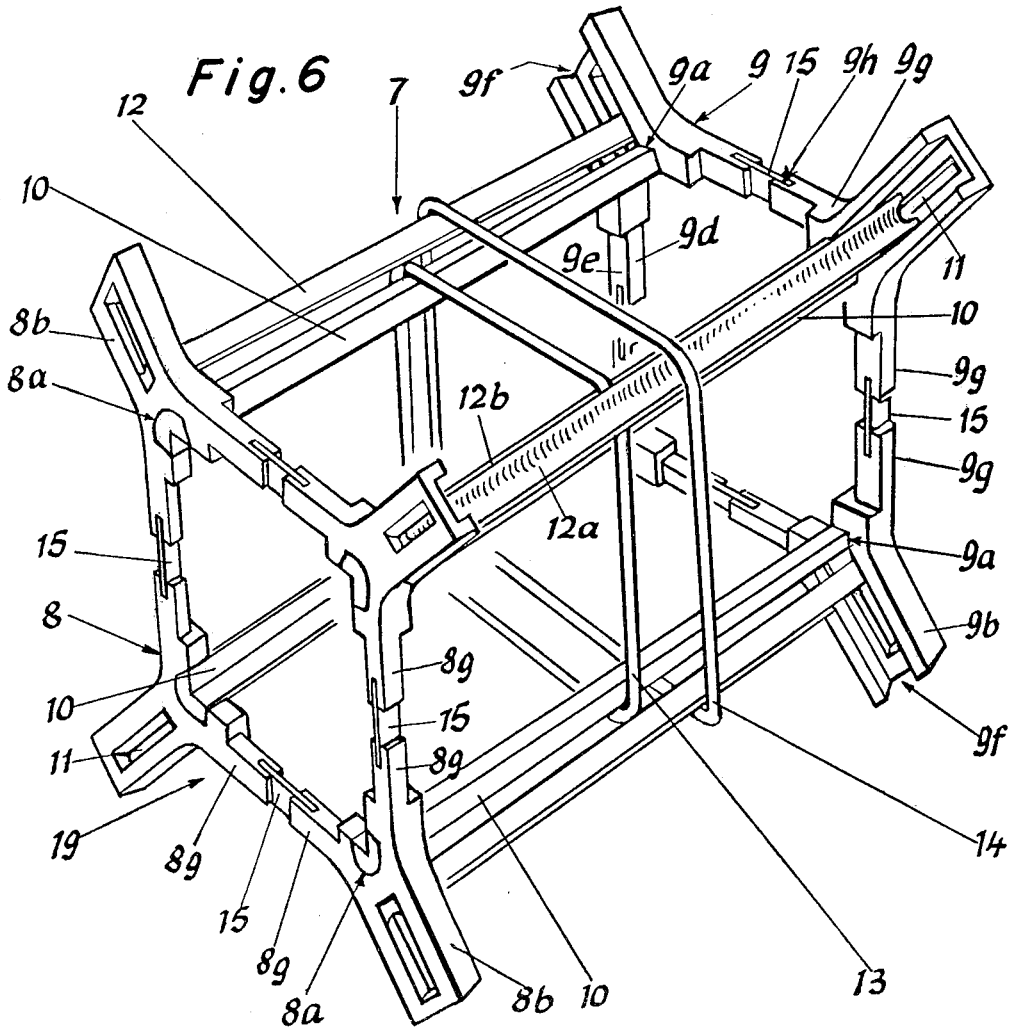
FIG. 6 is a perspective view of a coil form composed of profiled bars, distance pieces and rectangular plug-in frames with variable size.

FIG. 6 shows a coil form 7 consisting of two plug-in frames 8 and 9 having variable sizes, the frames being connected with each other in a detachable way by means of four profiled bars 10 which fit into the clearances 8*a* and 9*a* provided in frames 8 and 9, respectively. The profiled bars 10 are provided with a curved outside permitting an accurate application of the inner electric winding 13 without any risk of damage. At its inside the profiled bar 10 is provided with a right-angled clearance 10*b* extending over the total length of the bar and serving as a form-locking holder for the longitudinal edge of an iron core with rectangular cross section, which is not shown.

The plug-in coil form frame 7, shown in FIGS. 2 and 6, is variable in length in both the longitudinal and lateral directions. It has four elbow pieces, each of which comprises two leg sections 8g, 9g forming a right angle with each other and passing over into a flange 8b, 9b directed to the outside of the coil frame. Each of the leg sections 8g, 9g is provided with a rim slot 8h, 9h. To form a side of the frame 7, each pair of leg sections 8g, 9g is connected by means of a rectangular strip 15, the ends of which are clamped into the rim slots 8h, 9h. If necessary, the strips 15 may in addition be fastened at the connection points by means of adhesive material. It is obvious that at parallel sides of the plug-in frames 8, 9, which face each other, there must in any case be inserted strips 15 of equal length. The insertion of strips 15 of different length in complementary pairs permits the width and height of the plug-in frames 8, 9 to be changed accordingly.

Figure 7:
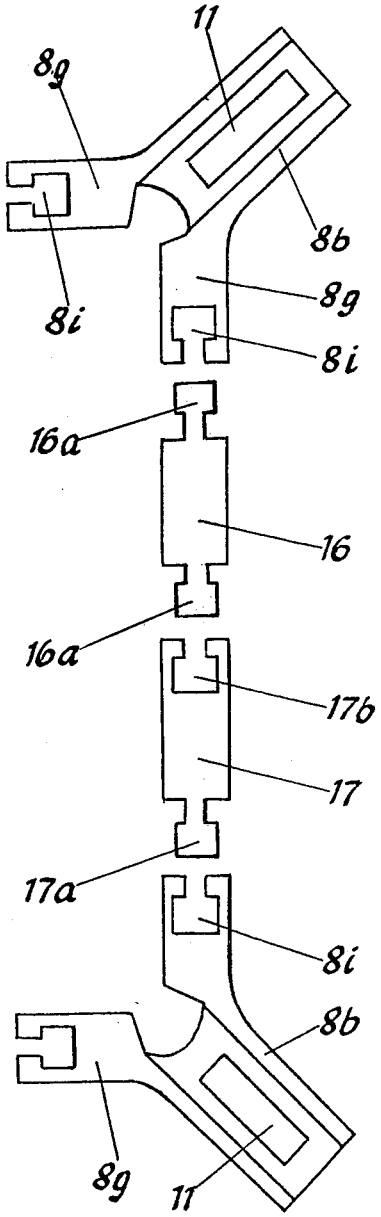
FIG. 7 is an exploded view of a component part of a plug-in frame with variable size, consisting of two flanges, a junction strip and an extrusion strip.

FIG. 7 shows a modified embodiment for the connection of two elbow pieces of a plug-in frame. In this case the leg sections 8g are provided with undercut slots 8i permitting the insertion of complementary shaped coupling heads 16a, 17a of junction strips 16 or extension strip 17. Such a form-locking involves the advantage that exactly defined side length can be produced without any further measures.

Figure 4:
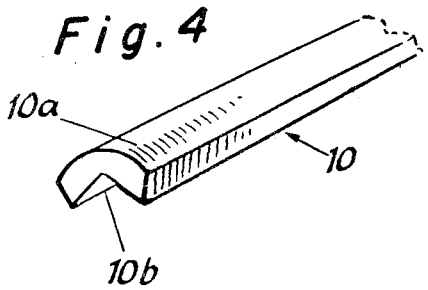
FIG. 4 is the perspective view of a profiled bar.
Figure 5:
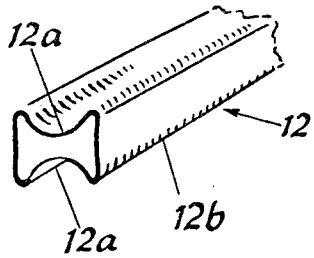
FIG. 5 is a perspective view of a distance piece.

The flanges 8b, 9b serve on the one hand as lateral supporters for electric coil windings 13, 14 and on the other hand as guiding elements for the distance coil supporting pieces 12. At the sides of the plug-in frames 8, 9, which face each other in the completely assembled coil form 7, the flanges 8b, 9b are each provided with a U-shaped notch or channel 8f, 9f. Each flange 8b, 9b has a slot 11 running parallel to its edges and communicating with the bottom of the notch 8f, 9f. As is best illustrated in FIG. 5, the distance pieces 12 have a quadrangular cross section and are provided with a continuous channel-shaped clearance 12a at two opposite longitudinal sides. They are inserted into the notches 8f, 9f of the flanges 8b, 9b in such a way that one of the clearances 12a faces the inner winding 13, whereas the other clearance 12a faces the outer winding, which is to be applied subsequently.

Between the inner winding 13 and the outer winding 14 the supporting pieces 12 create an air insulating cylindrical ring-shaped interspace, a so-called chimney, accessible from outside by the trapezoidal windows 19 at the two outer faces of the coil form 7. These windows are formed at the outside of the plug-in frame 8, 9 by two flanges 8b, 9b directed to the outside and the outer winding 14. Through these windows 19 the hot air produced in the charged windings 13, 14 can leave and cold air can stream into the cylindrical ring-shaped interspace.

According to the invention there are additional ventilating channels between the channel-shaped clearances 12a of the supporting pieces 12 and the respectively adjacent windings 13 or 14. The ventilating channels are positioned at the faces of the coil form in alignment with the slots 11 of the flanges 8b, 9b.

Figure 8:
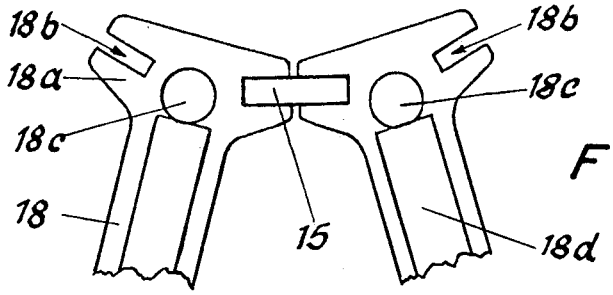
FIG. 8 shows two flanges of a duodecimal plug-in frame, which are joined to each other in a form-locking way.

In case the length of the coil form is to be variable only in the axial direction, for example for the purpose of disposing several coils side by side, the invention allows for the use of a compact plug-in frame 8, 9, with the frame 8 being shown in FIGS. 1 and 3. It will be understood that the frame 9 is identical, and reference numerals have accordingly been included. In this embodiment the sides 8c, 9c are provided with U-shaped clearances 8d, 9d directed to the inside, and they are as well provided with such clearances 8e, 9e, as seen in FIG. 3, at the sides of the plug-in frames 8, 9, which face each other. These clearances promote also an efficient air circulation for carrying off the heat produced. Of course the coil form 7 can likewise be provided with such clearances, as shown in FIG. 6. The invented coil form is of course not restricted to a quadrangular cross section, although this is the most common one. FIG. 8 shows the spacious correlation of two flanges 18 of a duodecimal plug-in frame, which are connected with each other by a strip 15. By analogy to the plug-in frame 8, 9 in FIG. 2, the leg sections 18a starting from the flanges 18 are each provided with two rim slots 18b for receiving the strip 15. The clearances 18c correspond to the clearances 8a previously described. The U-shaped notches are marked 18d.

We claim:

1. A coil form for a transformer having air-cooled electric windings, said coil form comprising:

a first set of profiled bars having a selectively variable length and substantially constant cross-section for simultaneously supporting an iron core and at least a first, inner coil winding;

a second set of profiled bars having a selectively variable length and a substantially constant cross-section for supporting a second coil winding spaced from the first winding;

means for removably holding said first and second sets of supporting bars in a spaced, substantially parallel relationship whereby an air gap is formed between the first and second coil windings, said holding means delimiting said first and second supporting means at their faces, said holding means comprising a pair of spaced, framelike members and means for removably holding said first and second sets of bars therebetween; and means for selectively varying the vertical and lateral dimensions of said pair of spaced framelike members.

2. A coil form according to claim 1 wherein each of said first set of profiled bars has a convexly curved outer surface and an inner surface provided with sides that form a substantially right angle, said inner surface conforming to the shape of a rectangular iron core.

3. A coil form as recited in claim 1 wherein each of said second set of bars has a generally rectangular cross-section, two faces of which are provided with a continuous, channel shaped clearance.

4. A coil form according to claim 1 wherein each frame-like member comprises at least three sides, the ends of two adjacent sides passing over to form an outwardly extending flange.

5. A coil form according to claim 4, wherein each frame-liike member comprises:

a plurality of elbow pieces having at least two leg portions, the proximal ends of which pass over to form an outwardly directed flange;

side members of any desired length for detachably joining adjacent elbow pieces to each other; and means for interlocking said side members to said elbow pieces, whereby a plug-in type frame is formed having sides of a desired length.

6. A coil form according to claim 5 wherein one of said leg portions of said elbow piece is provided with a pin-shaped distal end and the other of said leg portions is provided with a complementary pin-accepting distal end whereby adjacent elbow pieces are interlocked to form said frame-like member.

7. A coil form according to claim 5 wherein each leg portion of said elbow piece is provided with a rim slot at its distal end; and each side member comprises a strip of a desired length for insertion into the slots of adjacent leg portions;

whereby adjacent elbow pieces are joined to form said frame-like member by attaching said strips between adjacent elbow pieces.

8. A core form as recited in claim 5 wherein each leg portion of each elbow piece is provided with a pin-accepting notched distal end; and each side member comprises at least one junction strip having pin-shaped ends for interlocking with said pin-accepting distal ends of said leg portion.

9. A coil form according to claim 8 wherein each side member comprises at least one extension strip, one side of which has a pin-accepting notch and the other side of which has a complementary pin-shaped end whereby the pin-shape end is inserted into the notched end of an associated leg portion and the notched end of said extension strip interlocks with the pin-shaped end of said junction strip.

10. A coil form according to claim 4 wherein said outwardly directed flange has a substantially U-shaped cross-section for accommodating the ends of said second supporting means.

11. A coil form according to claim 4 wherein each flange is provided with a slot extending along the longitudinal axis of said flange.

12. A coil form as recited in claim 4 wherein each side of said frame-like member is provided with a U-shaped notch facing toward the opposite side of said frame-like member.

13. A coil form as recited in claim 4 wherein each side of said frame-like member is provided with a U-shaped notch which faces towards the interior of said coil form.

* * * * *